United States Patent [19]

Katsuno et al.

[11] Patent Number: 4,905,654

[45] Date of Patent: Mar. 6, 1990

[54] DEVICE FOR CONTROLLING AN INTERNAL COMBUSTION ENGINE

[75] Inventors: Toshiyasu Katsuno; Keiji Aoki, both of Susono; Yoshiki Chujo, Mishima, all of Japan

[73] Assignee: Toyota Jidosha Kabushiki Kaisha, Toyota, Japan

[21] Appl. No.: 266,098

[22] Filed: Nov. 2, 1988

[30] Foreign Application Priority Data

Nov. 2, 1987 [JP] Japan ..... 62-275634

[51] Int. Cl.[4] ..... F02D 41/18; F02D 45/00

[52] U.S. Cl. ..... 123/494; 123/478; 123/489

[58] Field of Search ..... 123/440, 489, 494, 478; 204/425, 426

[56] References Cited

U.S. PATENT DOCUMENTS 4,005,689 2/1977 Barnard .
4,272,329 6/1981 Hetrick .
4,768,491 9/1988 Nishida ..... 123/494

FOREIGN PATENT DOCUMENTS 55-75548 6/1980 Japan .

*Primary Examiner*—Tony M. Argenbright

[57] ABSTRACT

A control device for an internal combustion engine having an oxygen sensor, and calculation means for calculating a weight of oxygen fed to the internal combustion engine. The oxygen sensor outputs a signal corresponding only to a density of oxygen contained in intake gas fed to the engine. The oxygen sensor has a diffusion layer having pores through which oxygen molecules pass, the pores having a diameter less than or equal to the mean free path of the oxygen molecules contained in the intake gas.

12 Claims, 5 Drawing Sheets

DEVICE FOR CONTROLLING AN INTERNAL COMBUSTION ENGINE

BACKGROUND OF THE INVENTION

1. Field of the Invention

The present invention relates to a device for controlling an internal combustion engine, more particularly to a control device used for controlling a fuel injection or an ignition timing.

2. Description of the Related Art

In a D-J type fuel injection system for an internal combustion engine, a pressure sensor is provided in an intake passage (or a surge tank) downstream of a throttle valve of an intake system to sense an intake pipe pressure as a factor indicating a load of the engine. A flow rate of fresh air fed into a cylinder bore is obtained from the intake pipe pressure and the engine speed, so that the amount of fuel to be injected to obtain a predetermined air-fuel ratio is calculated, and the fuel injector then carries out a fuel injection.

Namely, in the D-J system, the intake pipe pressure is an important parameter when obtaining the amount of fresh air fed into the internal combustion engine, and therefore, if a change occurs in the intake pipe pressure due to exhaust gas recirculation (abbreviated as EGR below, an output value of a sensor sensing the intake pipe pressure must be corrected in accordance with the amount of EGR to obtain a correct amount of fresh air. In Japanese Unexamined Patent Publication No. 55-75548, for example, a differential pressure sensor is provided to determine a differential pressure between an upstream portion and downstream portion of a constant area orifice formed in an EGR passage, and an output value of an intake pipe pressure sensor is corrected based on a signal output from the differential pressure sensor in accordance with the amount of EGR, to obtain a correct amount of fresh air regardless of the EGR.

Therefore, in a conventional D-J type fuel injection system, the intake pipe pressure sensor senses not only the amount of fresh air but also the flow rate of gases including the EGR gas, blowby gas and the like fed into the internal combustion engine. Accordingly, the contribution of the EGR gas and blowby gas to the intake pipe pressure is sensed to correct the output value of the intake pipe pressure sensor and thereby obtain the correct amount of fresh air to be fed into the internal combustion engine. Therefore, since the amount of fresh air is not directly sensed in a conventional system, the sensing accuracy is low, and thus the internal combustion engine can not be controlled with high accuracy.

In copending U.S. patent application No. 07/151,422 filed on 2 Feb. 1988, now abandoned, the present applicant proposed a construction in which an oxygen sensor sensing a partial pressure of oxygen contained in an intake system is provided, to obtain a weight of oxygen in fresh air from the partial pressure of the oxygen, to thereby provide a more accurate control of the internal combustion engine.

The oxygen sensor provided in the above proposed construction, however, is affected not only by a partial pressure of oxygen but also by a total pressure of oxygen, so that a weight of oxygen of fresh air cannot be obtained with high accuracy, and therefore, the control of the internal combustion engine is not absolutely accurate.

SUMMARY OF THE INVENTION

Therefore, an object of the present invention is to provide a control device by which a weight of oxygen is sensed with a higher accuracy than with a conventional device, thus achieving more accurate control of the internal combustion engine.

According to the present invention, there is provided a device for controlling an internal combustion engine; the control device comprising an oxygen sensor and calculating means. The oxygen sensor is provided in the internal combustion engine and outputs a signal corresponding only to a density of oxygen contained in intake gas fed to the internal combustion engine, and the calculating means calculates a weight of oxygen fed to the internal combustion engine, based on the signal from the oxygen sensor, to obtain a factor for controlling the internal combustion engine in accordance with the weight of the oxygen.

BRIEF DESCRIPTION OF THE DRAWINGS

The present invention may be more fully understood from the description of preferred embodiments of the invention set forth below, together with the accompanying drawings, in which.

DESCRIPTION OF THE PREFERRED EMBODIMENTS

The present invention will now be described below with reference to the embodiments shown in the attached drawings.

Figure 1:
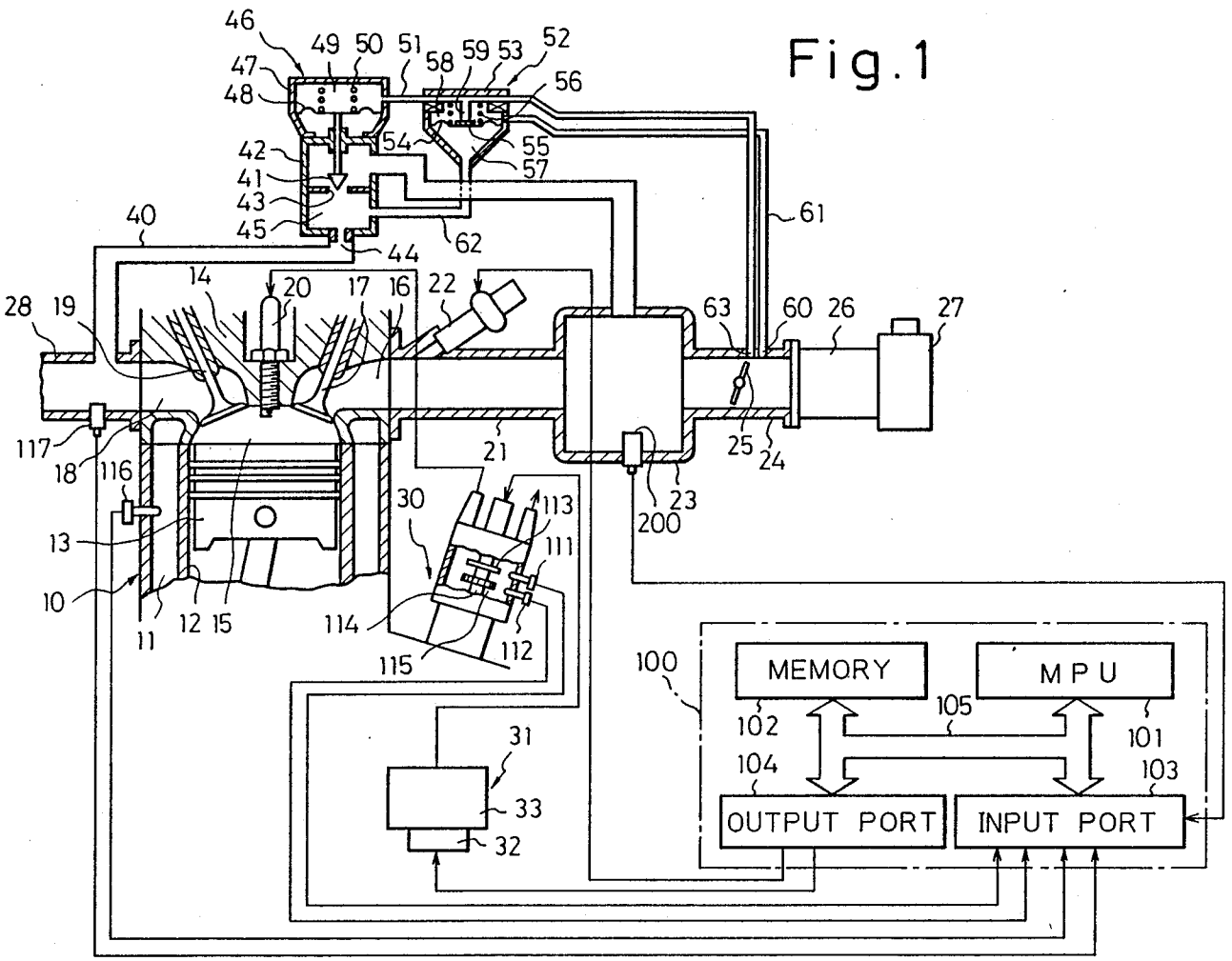
FIG. 1 is a sectional view of a first embodiment of the present invention.

In FIG. 1, showing a first embodiment of the present invention, a cylinder block 10 is formed with a water jacket 11 and a cylinder bore 12 in which a piston 13 is slidably housed, and a cylinder head 14 is mounted on the cylinder block 10 to form a combustion chamber 15 together with the cylinder bore 12 and the piston 13. The cylinder head 14 has an intake port 16 formed therein, which is opened and closed by an intake valve 17, and an exhaust port 18 which is opened and closed by an exhaust valve 19. A spark plug 20 is fixed to the cylinder head 14 and projects into the combustion chamber 15.

An intake manifold 21 is connected to the cylinder head 14 to communicate with the intake port 16, and a fuel injector 22 is provided at the intake manifold 21 to inject fuel to the intake port 16. A surge tank 23 is formed in the intake manifold 21, and a throttle body 24 having a throttle valve 25 is connected to the surge tank 23. An intake pipe 26 is also connected to the surge tank 23, and an air cleaner element 27 is connected to the intake pipe 26. Further, an exhaust manifold 28 is connected to the exhaust port 18.

A distributor 30 is fixed to the cylinder block 10 and connected to the spark plug 20, and an ignition device 31 having an igniter 32 and an ignition coil 33 is connected to the distributor 30.

An EGR pipe 40 connects the exhaust manifold 28 to the surge tank 23 to circulate a part of exhaust gas to the intake manifold 21, and an EGR valve 41 is provided in a casing 42 disposed in the EGR pipe 40 and opens and closes a hole 43 formed in the casing 42 to control an EGR ratio. The casing 42 has an orifice 44 formed near the exhaust manifold 28 relative to the hole 43, and a control chamber 45 located between the orifice 44 and the hole 43.

The EGR valve 41 is driven by a diaphragm mechanism 46 having a shell 47 fixed to the casing 42, a diaphragm 48 disposed in the shell 47 to define a vacuum chamber 49 in the shell 47, and a spring 50 provided in the vacuum chamber 49. The vacuum chamber 49 is connected to a pipe 51 communicating with an EGR port 63 formed in the throttle body 24 and located slightly upstream of the idle position of the throttle valve 25. The EGR valve 41 is connected to the diaphragm 48 and projects into the casing 42 to open and close the hole 43 in accordance with a pressure in the vacuum chamber 49.

A control valve mechanism 52 is provided for controlling pressures in the control chamber 45 and the vacuum chamber 49, and has a shell 53, a diaphragm 54, a valve 55, and a spring 56. The diaphragm 54 defines a pressure chamber 57 and a spring chamber 58 in the shell 53. The pipe 51 passes through the spring chamber 58, and has a branch mouth 59 located in the spring chamber 58, and the valve 55 is fixed to the diaphragm 54 to open and close this mouth 59.

The spring 56 is provided in the spring chamber 58 to urge the valve 55 in a direction in which the valve 55 opens the mouth 59. The spring chamber 58 communicates through a pipe 61 with a vacuum port 60 formed in the throttle body 24 and located slightly upstream of the EGR port 52. The pressure chamber 57 communicates with the control chamber 45 through a pipe 62, and a pressure in the pressure chamber 57 urges the valve 55 in a direction in which the valve 55 closes the mouth 59.

Therefore, when the throttle valve 25 is slightly open to generate a negative pressure in the EGR port 63, this negative pressure is conducted to the vacuum chamber 49, and accordingly, the diaphragm 48 and the valve 41 are displaced to open the hole 43, and thus a part of the exhaust gas is circulated through the EGR pipe 40 to be supplied to the surge tank 23. If a pressure in the control chamber 45 becomes low, the pressure in the pressure chamber 57 also becomes low, and thus the valve 55 opens the mouth 59 due to a spring force of the spring 56 and the negative pressure conducted to the vacuum chamber 49 is reduced. As a result, the valve 41 is displaced to decrease the degree of opening thereof, so that the pressure in the control chamber 45 is raised, and therefore, the pressure in the control chamber 45 is maintained substantially at a constant value while the degree of opening of the throttle valve 25 is small.

Further, when the throttle valve 25 is wide open, a negative pressure is generated in the vacuum port 60, and is transmitted to the spring chamber 58, so that the valve 55 closes the mouth 59. In this state, although a negative pressure in the EGR port 52 is small, and a negative pressure in the vacuum chamber 49 is also small, because the valve 55 has closed the mouth 59, the negative pressure in the vacuum chamber 49 does not become smaller than the negative pressure in the vacuum port 60, and therefore, the valve 41 is opened by more than a predetermined degree of opening, so that a pressure in the control chamber 45 is kept higher than a predetermined value. Accordingly, the pressure in the control chamber 45 is controlled so that the EGR ratio is controlled in accordance with an engine load.

A control circuit 100 is constructed as a microcomputer system to carry out a fuel injection control, an ignition timing control, and other controls for an internal combustion engine. The control circuit 100 includes a micro-processing unit (MPU) 101, a memory 102, an input port 103, an output port 104, and a bus 105 interconnecting these components. The input port 103 is connected to sensors so that signals indicating an engine condition are input to the control circuit 100.

First and second crank angle sensors 111 and 112 are provided on the distributor 30; the first crank angle sensor 111 facing a magnet 113 fixed to a distributor shaft 114 of the distributor 30, and outputting a pulse signal at every 720 degrees crank angle, i.e., every one cycle of the engine. This pulse signal is used as a standard signal for controlling the engine. The second crank angle sensor 112 faces a magnet 115 fixed to the distributor shaft 114, and outputs a pulse signal at every 30 degrees crank angle. This pulse signal is used as a trigger signal for a fuel injection control or an ignition timing control.

A water temperature sensor 116 is provided in the water jacket 11 to sense a temperature of the cooling water in the water jacket 11.

An exhaust oxygen sensor 117 is mounted on the exhaust manifold 28 to sense a density of oxygen contained in the exhaust gas. This oxygen sensor 117 is provided for a feedback control of an air-fuel ratio. In a system for controlling the air-fuel ratio to the stoichiometric air-fuel ratio, the oxygen sensor 117 may be an $O_2$ sensor, and in a system for controlling the air-fuel ratio to a lean value relative to the stoichiometric air-fuel ratio, the oxygen sensor 117 may be a lean sensor.

An intake oxygen sensor 200 is mounted on the surge tank 23. This oxygen sensor 200 is used for sensing an amount of fresh air fed to the engine, in order to calculate the amount of fuel to be injected and an ignition timing required.

Figure 2:
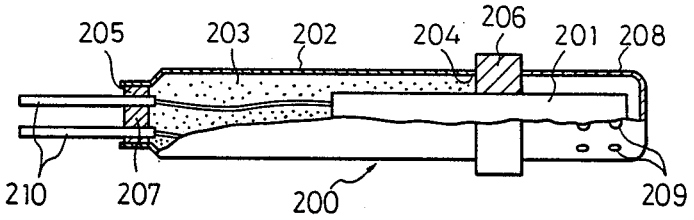
FIG. 2 is a view, partially in cross-section, of an oxygen sensor.

FIG. 2 shows a general construction of the oxygen sensor 200. A sensing element 201 is housed in a cylindrical casing 202, which is filled with an inorganic material 203 to fix the sensing element 201 therein. The casing 202 has two openings 204 and 205; the opening 204 being closed by a cover 206 and the opening 205 being fluid-tightly closed by a rubber bush 207. An end portion of the sensing element 201 passes through the cover 206 and projects from the casing 202; the projecting end portion of the sensing element 201 being covered by a protection cover 208 having a plurality of holes 209 formed therein. A pair of leads 210 are connected to the base portion of the sensing element 201, and pass through the bush 207 to be extended outside the casing 202 and connected to an electric source (not shown).

The oxygen sensor 200 is fixed to the surge tank 23 in such a manner that the end portion of the sensing element 201 and the cover 208 are located in the surge tank 23. Accordingly, a part of the intake air passes through the holes 209 and flows into the sensing element 201 so that, as described below, a density of oxygen contained in the air is detected.

Figure 3:
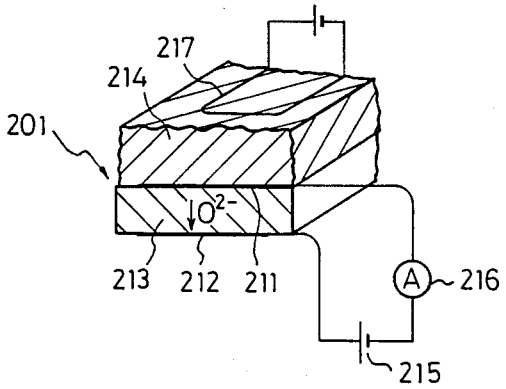
FIG. 3 is a cross-sectional view in perspective of a main part of a sensor element.

FIG. 3 shows a construction of the sensing element 201. Platinum electrodes 211 and 212, which are air-permeable films, are provided on both surfaces of a solid-electrolyte material 213 composed of zirconia. A porous diffusion layer 214 made of a ceramic material is disposed on the platinum electrode 211. The platinum electrode 211 is a negative pole, and the platinum electrode 212 is a positive pole, and these platinum electrodes 211 and 212 are connected to an electric source 215. An ammeter 216 is provided between the negative platinum electrode 211 and the electric source 215. A heater 217 made of platinum is disposed on a surface of the diffusion layer 214 opposite to the platinum electrode 211, and heats the solid-electrolyte material 213 to a predetermined temperature (e.g., 600–700° C.) to activate the solid-electrolyte material 213.

Intake gas passes through the holes 209 in the cover 208 of the oxygen sensor 200 and flows into pores of the diffusion layer 214 of the sensing element 201. Oxygen molecules contained in the intake gas are then ionized by the platinum electrode 211, and the thus-obtained oxygen ions are conducted through the solid-electrolyte material 213 to reach the platinum electrode 212. The oxygen ions are then changed into oxygen molecules by the platinum electrode 212, so that an electric current flows through a circuit including the ammeter 216, and thus an electric current corresponding to the amount of oxygen ions passing through the solid-electrolyte material 213 is sensed by the ammeter 216.

This amount of oxygen ions corresponds to a density of oxygen contained in the intake gas, as described later, and the control circuit 100 calculates a weight of oxygen fed to the internal combustion engine based on this density of oxygen, by a program (not shown) stored in the memory 102. The control circuit 100 also calculates a factor for controlling the internal combustion engine, such as an opening period (i.e., a fuel injection quantity) of the fuel injector 22, in accordance with the weight of oxygen. An actuator (not shown) causes the injector 22 to open for this opening period, so that an amount of fuel corresponding to the weight of oxygen is injected.

Figure 4:
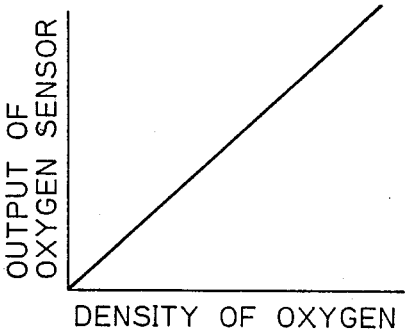
FIG. 4 is a graph showing a relationship between a density of oxygen and an output signal of the oxygen sensor.

The oxygen sensor 200 is constructed in such a manner that a signal corresponding only to a density of oxygen contained in the intake gas fed to the internal combustion engine is output. For this purpose, a diameter of pores formed in the diffusion layer 214 of the oxygen sensor 200 is such that a diffusion of molecules contained in the intake gas is restricted. More particularly, this diameter is substantially less than or equal to the mean free path of the molecules contained in the intake gas. Namely, molecules of the intake gas passing through the diffusion layer 214 collide with wall surfaces of the pores of the diffusion layer 214 before the molecules collide with each other. In other words, the molecules are not subjected to a molecule diffusion but to a Knudsen diffusion. Therefore, as described later, the sensing element 201 is not affected by a total pressure of the intake gas, so that the oxygen sensor 200 senses a density of the oxygen; i.e., the oxygen sensor 200 outputs a signal in proportion to a density of oxygen, as shown in FIG. 4.

The properties of oxygen sensors in which a molecule diffusion and a Knudsen diffusion are carried out, respectively, differ as follows.

An output I of the oxygen sensor 200 is generally expressed as follows, $$I = C_1 \cdot D_{O2} \cdot P_{O2} \tag{1}$$

wherein $C_1$ is a constant value, $D_{O2}$ is a diffusion coefficient of the oxygen, and $P_{O2}$ is a partial pressure of oxygen contained in the intake gas, and $D_{O2}$ is changed in accordance with a diffusion condition, i.e., a diameter of pores formed in the diffusion layer 214, as described below.

Both a Knudsen diffusion and a molecule diffusion can be carried out in a diffusion layer, and thus $D_{O2}$ is expressed as follows, $$D_{02} = \frac{D_{02}^{K} \cdot D_{02}^{B}}{\alpha D_{02}^{K} + \beta D_{02}^{B}}, \tag{2}$$

wherein $D_{O2}^{K}$ is a Knudsen diffusion coefficient, is a molecule diffusion coefficient, and $\alpha$ and $\beta$ are determined in accordance with a diameter of pores formed in the diffusion layer 214, as described later with reference to FIG. 5. Note that, in a Knudsen diffusion, the molecules collide with an inner wall of the pores before colliding with the other molecules, but in a molecule diffusion, the molecules do collide with each other. Both the Knudsen diffusion and the modecule diffusion occur in depending upon the diameter of the pores.

Figure 5:
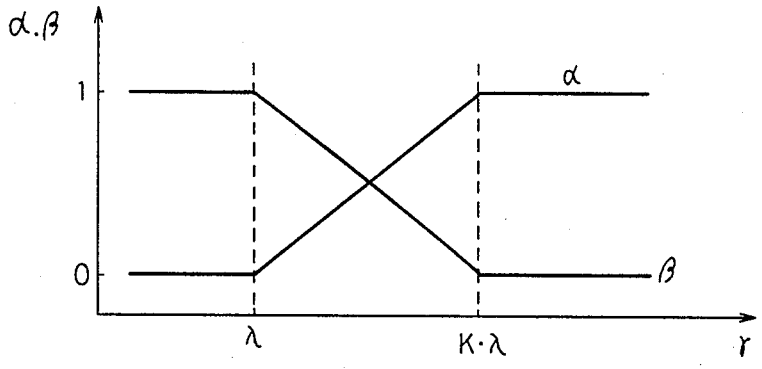
FIG. 5 is a graph showing a relationship between a diameter of pores formed in a diffusion layer and coefficients of a Knudsen diffusion and a molecule diffusion.

In FIG. 5 $\gamma$ is a diameter of pores formed in the diffusion layer 214, $\lambda$ is the mean free path, and K is a constant value. As shown in this drawing, if the diameter is less than $\lambda$, $\alpha=0$, and $\beta=1$, and if the diameter is larger than $K \cdot \lambda$, $\alpha=1$, and $\beta=0$. If the diameter is between $\lambda$ and $K \cdot \lambda$, as the diameter is increased, $\alpha$ is increased and $\beta$ is decreased.

The molecule diffusion coefficient is expressed as $$D_{02}^{B} = \frac{C_2}{P}, \tag{3}$$

wherein P is a total pressure, and $C_2$ is a constant value.

The Knudsen diffusion coefficient is expressed as $$D_{O2}^{K} = C_3 \cdot \gamma \tag{4}$$

wherein $C_3$ is a constant value, and $\gamma$ is a diameter of pores.

Therefore, if a molecule diffusion is carried out in pores of the diffusion layer, an output signal of the oxygen sensor is affected by a total pressure of gas fed to the sensor.

Figure 6:
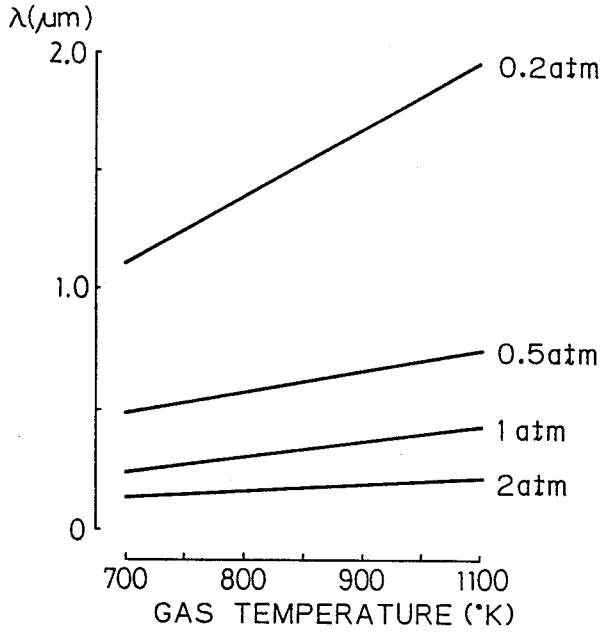
FIG. 6 is a graph showing a relationship between a temperature of gas and a mean free path of molecules.

In a conventional oxygen sensor, the diameter of pores is about 10 $\mu$m. As understood from FIG. 6, the means free path $\lambda$ of molecule increases in accordance with a temperature of gas, and becomes smaller as a total pressure of gas is increased. For example, when a total pressure of gas is 1 atm, and a gas temperature is 700° K., the mean free path of a molecule is 0.5–0.7 $\mu$m, so that the diameter of pores is large enough for a molecule diffusion to be carried out, and therefore, the conventional oxygen sensor is affected by a total pressure.

In an actual internal combustion engine, if a supercharger is not provided, a pressure in an intake pipe is about 1 atm when the throttle valve is fully open. Since an oxygen sensor is heated to more than 850°–1000° K. by a heater, a temperature of a sensing element is more than 700° K., and therefore, at that time the mean free path of a molecule is about 0.3 μm. Accordingly, a diameter of pores of the diffusion layer 214 should be less than about 0.3 μm, so that the oxygen sensor 200 can sense a partial pressure of oxygen without being affected by a total pressure.

Conversely, if a supercharger is provided in the internal combustion engine, a pressure in the intake pipe reaches about 2 atm when the throttle valve is fully open. Therefore, as in the above case, a diameter of pores of the diffusion layer 214 should be less than about 0.1 μm.

But since an engine is usually driven in a low or medium load condition, the diameter of the pores may be less than 1.0 μm.

In a Knudsen diffusion, an equation expressing an output of the oxygen sensor 200 is obtained from (1) and (4), and is expressed as follows, $$\begin{aligned} I &= C_1 \cdot C_3 \cdot \gamma \cdot P_{02} \\ &= C_4 \cdot Q \cdot P_{02} \end{aligned} \quad (5)$$

wherein $C_4$ is a constant value.

In an intake stroke in each cylinder, a weight of oxygen W in the cylinder is expressed as follows, $$\begin{aligned} W &= \frac{M_{02} \cdot V}{R} \cdot \frac{P_{02}}{T} \\ &= C_5 \cdot P_{02} \end{aligned} \quad (6)$$

wherein $M_{02}$ is a molecular weight of the oxygen, V is a volume of an combustion chamber, R is a gas constant, $R_{02}$ is a partial pressure of the oxygen, T is a temperature of gas in the combustion chamber, and $C_5$ is a constant value including T. Therefore, using the equation (5), the equation (6) is changed as follows, $$\begin{aligned} W &= \frac{C_5 I}{C_4 \gamma} \\ &= C_6 \cdot I \end{aligned} \quad (7)$$

wherein $C_6$ is a constant value.

Figure 7:
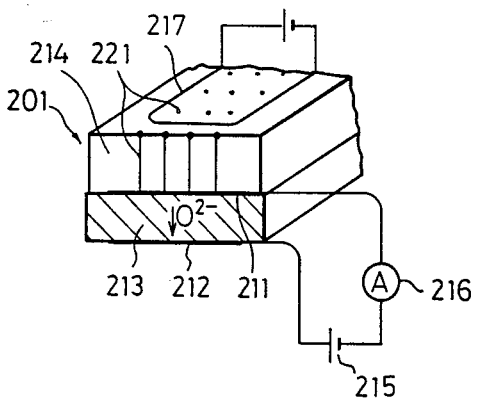
FIG. 7 is a cross-sectional view in perspective of a main part of another sensor element.

FIG. 7 shows another embodiment of the sensing element 201, wherein the diffusion layer 214 is formed with a plurality of pores 221 extending through the diffusion layer 214 from an outside surface 222 of the diffusion layer 214 to the platinum electrode 211. The pores 221 are formed by a laser radiation in which the light source is an excimer laser, whereby pores having a diameter about 0.5 μm can be formed. The pores may be formed by an electron beam radiation or an X-ray irradiation, and can have a diameter of 0.1 μm. Intake gas passes through the pores 221 and reaches the platinum electrode 211 and the solid-electrolyte material 213. The diameter of the pores 221 is such that molecules of the intake gas carry out a Knudsen diffusion, as in the embodiment shown in FIG. 3. The remaining construction and operation are the same as those of the sensing element shown in FIG. 3.

Figure 8:
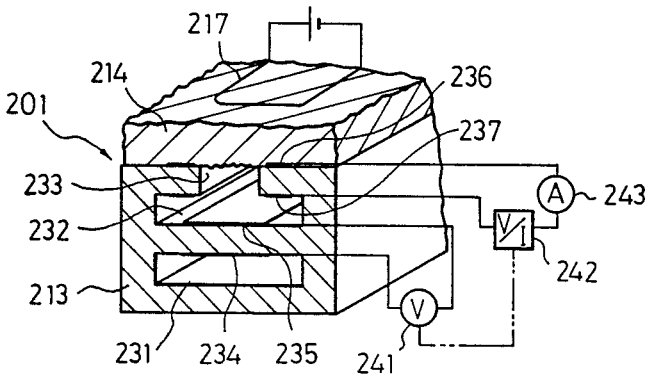
FIG. 8 is a cross-sectional view in perspective of a main part of yet another sensor element; and, FIG. 9 is a sectional view of a second embodiment of the present invention.

FIG. 8 shows a still further embodiment of the sensing element 201, wherein the solid-electrolyte material 213 through which oxygen ions are conducted has an atmospheric chamber 231 communicating with the atmosphere and a gas chamber 232 having an opening 233 which is closed by the diffusion layer 214. A platinum electrode 234 is provided on a surface of the solid-electrolyte material 213 and faces the atmospheric chamber 231, and a platinum electrode 235 is provided on the other surface of the solid-electrolyte material 213 and faces the gas chamber 232. A platinum electrode 236 is sandwiched between the diffusion layer 214 and the solid-electrolyte material 213, and a platinum electrode 237 is provided on a surface of the solid-electrolyte material 214 opposite to the platinum electrode 236, and faces the gas chamber 232. A diameter of pores formed in the diffusion layer 214 is such that a Knudsen diffusion is obtained in the pores.

A voltmeter 241 for sensing a voltage is provided between the platinum electrodes 234 and 235. Since the atmospheric chamber communicates with the atmosphere, an electric current corresponding to a pressure difference of oxygen in the atmospheric chamber 231 and in the gas chamber 232 is passed between the platinum electrodes 234 and 235, so that a voltage corresponding to a partial pressure of oxygen in the gas chamber 232 is generated between the platinum electrodes 234 and 235. In this embodiment, this voltage is controlled to a constant value, i.e., a partial pressure of oxygen in the gas chamber 232 is controlled to a constant value, as described below.

To realize the above described control, the platinum electrodes 236 and 237 are connected to a voltage-current converter 242 and an ammeter 243. A voltage from the voltmeter 241 is input to the voltage-current converter 242, which then outputs an electric current in accordance with the voltage output by the voltmeter 241. Namely, the voltage-current converter 242 senses the voltage generated between the platinum electrodes 234 and 235, and the lower the voltage, i.e., a partial pressure of oxygen in the gas chamber 232, the higher the electric current generated by the voltage-current converter 242, whereby oxygen molecules are sucked into the gas chamber 232 through the diffusion layer 214. A diameter of pores formed in the diffusion layer 214 is such that molecules carry out a Knudsen diffusion, and therefore, the ammeter 243 indicates a value corresponding to a density of oxygen contained in the intake gas.

Figure 9:
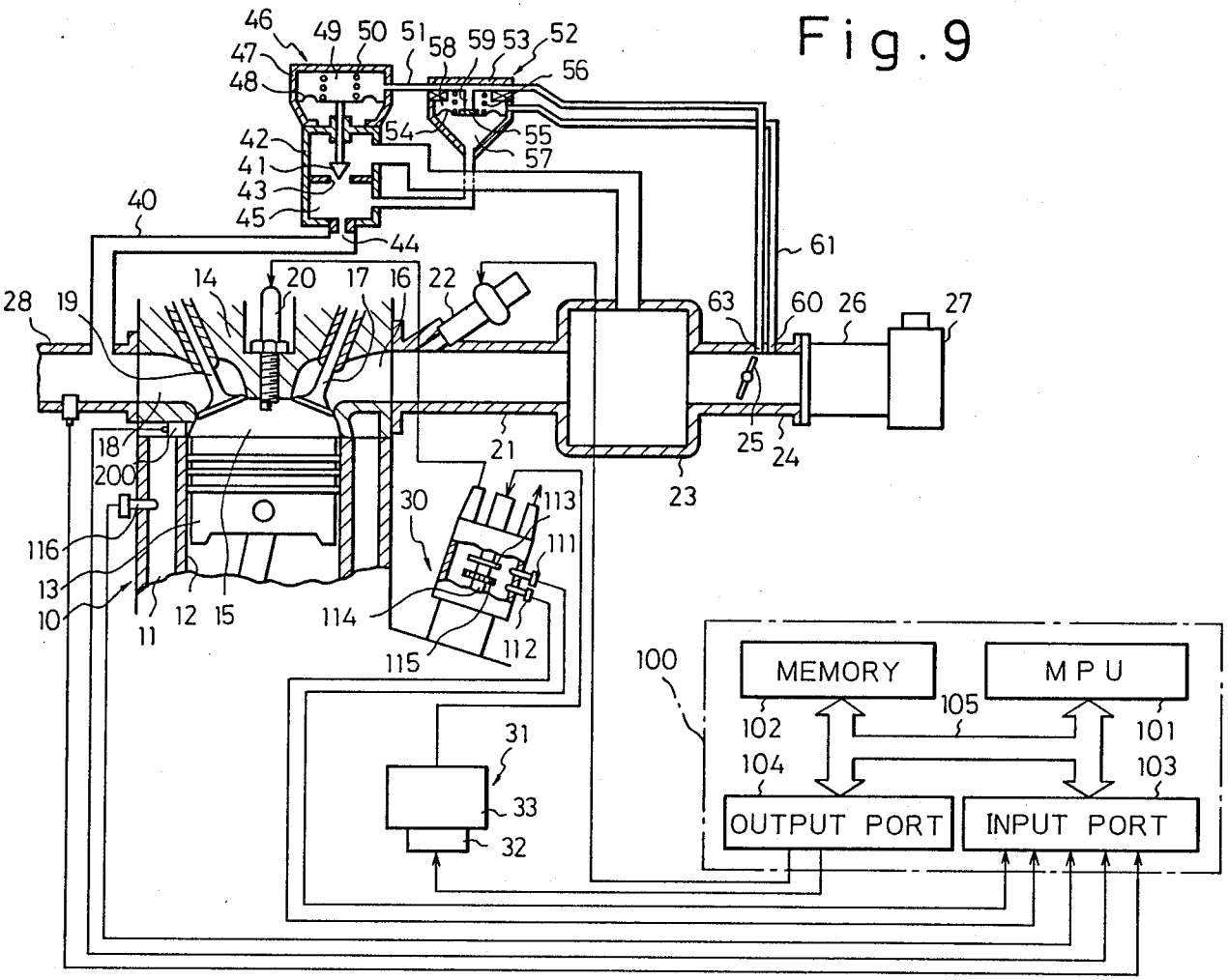

FIG. 9 shows a second embodiment of the present invention, in which the oxygen sensor 200 is provided between the cylinder block 10 and the cylinder head 14, and faces the combustion chamber 15. The remaining construction is the same as that of the first embodiment shown in FIG. 1.

As described above, according to the embodiments of the present invention, since a density of oxygen in intake gas is sensed, a weight of oxygen is directly obtained, and therefore, when controlling an internal combustion engine, it is not necessary to correct a signal from the $O_2$ sensor in accordance with a total pressure of the intake gas and a temperature of the intake gas. Namely, in these embodiments, errors due to these corrections are not generated, and thus an intake gas temperature sensor can be omitted.

Although embodiments of the present invention have been described herein with reference to the attached drawings, many modifications and changes may be made by those skilled in this art without departing from the scope of the invention.

We claim:

1. A device for controlling an internal combustion engine, said control device compr[illegible]g:

an oxygen sensor provided in said internal combustion engine and outputting a signal corresponding only to a density of oxygen contained in intake gas fed to said internal combustion engine, and means for calculating a weight of oxygen fed to said internal combustion engine, based on said signal from said oxygen sensor, to obtain a factor for controlling said internal combustion engine in accordance with said weight of oxygen.

2. A device according to claim 1, wherein said oxygen sensor is provided downstream of a throttle valve provided in an intake system of said internal combustion engine.

3. A device according to claim 1, wherein said oxygen sensor faces a combustion chamber of said internal combustion engine.

4. A device according to claim 1, wherein said oxygen sensor has a diffusion layer restricting a diffusion of molecules contained in said intake gas and flowing into said oxygen sensor.

5. A device according to claim 4, wherein said diffusion layer has pores through which oxygen molecules pass, said pores having a diameter substantially less than or equal to a mean free path of said oxygen molecules contained in said intake gas.

6. A device according to claim 5, wherein said diameter of said pores is less than 1.0 $\mu$m.

7. A device according to claim 5, wherein said pores extend straight through said diffusion layer from one surface of said diffusion layer to the other surface of said diffusion layer opposite to said one surface.

8. A device according to claim 4, wherein said oxygen sensor further comprises:

a first electrode located adjacent to said diffusion layer and ionizing oxygen molecules passing through said diffusion layer, a solid-electrolyte material through which thus-obtained oxygen ions are conducted, a second electrode provided at the opposite side to said first electrode of said solid-electrolyte material and changing said oxygen ions conducted through said solid-electrolyte material into oxygen molecules, and means for sensing an amount of electric current corresponding to said oxygen ions conducted through said solid-electrolyte material.

9. A device according to claim 8, further comprising a heater activating said solid-electrolyte material, said heater being disposed on a surface of said diffusion layer opposite to said first electrode.

10. A device according to claim 4, wherein said oxygen sensor further comprises;

a solid-electrolyte material through which oxygen ions are conducted, and having an atmospheric chamber communicating with the atmosphere and a gas chamber closed by said diffusion layer, voltage output means for outputting a voltage corresponding to a partial pressure of oxygen in said gas chamber, and current output means for outputting an electric current corresponding to said output voltage.

11. A device according to claim 8, wherein said voltage output means comprises:

a third electrode provided on said solid-electrolyte material and facing said atmospheric chamber, a fourth electrode provided on said solid-electrolyte material and facing said gas chamber, and sensing means for sensing a voltage generated between said third and fourth electrodes by said voltage output means.

12. A device according to claim 10, wherein said current output means comprises:

a fifth electrode provided between said diffusion layer and said solid-electrolyte material, a sixth electrode provided on a surface of said solid-electrolyte material and facing said gas chamber, and current generating means for generating an electric current between said fifth and sixth electrodes in accordance with an amount of said voltage output by said voltage output means.

* * * * *